United States Patent [19]

Fournet

[11] 4,184,278

[45] Jan. 22, 1980

[54] COMBINATION MIRROR AND DISPLAY DEVICE

[76] Inventor: Richard S. Fournet, 5932 W. Lindenhurst, Los Angeles, Calif. 90017

[21] Appl. No.: 879,049

[22] Filed: Feb. 21, 1978

[51] Int. Cl.[2] ..... G09F 1/12

[52] U.S. Cl. ..... 40/152.1; 40/158 R

[58] Field of Search ..... 40/152, 152.1, 156, 40/158

[56] References Cited

U.S. PATENT DOCUMENTS

| | | | |
|---|---|---|---|
| 950,912 | 3/1910 | Harrington | 40/493 |
| 1,262,101 | 4/1918 | Sabatelli | 40/152 |
| 2,677,910 | 5/1954 | Morgan | 40/158 R |
| 2,785,490 | 3/1957 | Fabry | 40/156 |
| 3,553,873 | 1/1971 | Weston | 40/156 |
| 3,837,987 | 9/1974 | Williams et al. | 40/152.1 |
| 3,885,336 | 5/1975 | Olsen | 40/152 |

*Primary Examiner*—Louis G. Mancene
*Assistant Examiner*—Wenceslao J. Contreras
*Attorney, Agent, or Firm*—James E. Brunton

[57] ABSTRACT

A combination mirror and display device for displaying photographs and the like. The device comprises a display unit reversably mounted on a rigid planar support member adapted to sit on a desk, credenza, dressing table or the like in a free standing configuration. Magnetic strips hold the display unit securely in position on the support member. When the display unit is positioned on the support member with the photograph side facing outwardly the unit appears to be a conventional picture frame. Due to its unique design, however, the display unit can readily be reversed so that the device can conveniently be used as a free standing mirror.

6 Claims, 3 Drawing Figures

COMBINATION MIRROR AND DISPLAY DEVICE

BACKGROUND OF THE INVENTION

1. Field of the Invention

This invention relates generally to display devices and more particularly to a display device having a reversable display unit for removably supporting on one side thereof a photograph, or the like, and having on the opposite side thereof a mirror.

2. Discussion of the Prior Art

The basic concept of a combined looking glass and photographic frame was suggested in the early U.S. patent to Shatto No. 153,282. In the device of the Shatto invention, however, the display unit, having the mirror on one side and the photograph on the other, was hingably connected to a recessed supporting frame. With this construction, when the mirror side of the device was to be used the display unit had to be pivoted about the axis of the hinge member into an open position. In the open position the device is somewhat unstable and the inside recessed portion of the supporting member is undesirably exposed to view.

The device of the present invention offers significant advantages over the prior art devices. In the device of the present invention the display unit is magnetically held securely in position on a free-standing support member. The display unit can readily be reversed relative to the support member so that in a first position the photograph faces outwardly and in a second, reversed position the mirror faces outwardly. In both positions, the display unit is centered relative to the support member and the device may conveniently be placed on a desk or dressing table in a stable free-standing position.

Due to the unique design of the display unit of the device of the present invention, the photograph can be quickly and easily removed from the display unit and be replaced with another photograph, line drawing, or similar display sheet.

SUMMARY OF THE INVENTION

It is a primary objective of the present invention to provide a novel combination mirror and display device for displaying photographs, line drawings, illustrations, or like display sheets.

More particularly it is an objective of the invention to provide a display device which can be placed in a free-standing configuration on a desk, credenza, or dressing table with either the photograph or the mirror facing outwardly. When the photograph is facing outwardly the design of the device is such that it appears to be a standard photographic frame.

It is another object of the present invention to provide a display device of the aforementioned character which comprises a free-standing support unit and a cooperating display unit for displaying the mirror on one side and a photograph on the other side. The display unit is provided with a peripheral rim portion constructed of a magnetic material so that the display unit can be firmly united with the support unit solely by the use of magnetic means, whereby the necessity of employing hinges is dispensed with.

Another object of the invention is to provide a device of the aforementioned character in which the magnetic means which hold the display unit firmly against the support member are completely concealed by the display unit.

It is still another object of the invention to provide a device of the character described in which the support member is provided with a notched-out portion to facilitate the separation of the display unit from the support base, so that the display unit can be readily and quickly reversed.

It is another object of the present invention to provide a device as described in the preceeding paragraphs in which the photograph or similar display sheet mounted within the display unit can be easily removed therefrom and replaced with a substitute display sheet.

It is yet another object of the invention to provide a device of the aforementioned character which includes novel resiliently compressible retaining means removably carried within the display unit and adapted to firmly hold both the mirror and the display sheet in a fixed position within the display unit.

Finally, it is still another object of the invention to provide a strong, rugged and durable device of the class described which is relatively inexpensive to manufacture, which can be made in various sizes, and which is highly attractive in appearance.

These and other objects of the invention are realized by a combination mirror and display device comprising a body portion having an opening therein and oppositely disposed peripheral rim portions connected to the peripheral edges of the body portion and presenting first and second faces constructed of a magnetic material; a mirror receivable through the opening in the body for mounting within the body intermediate of the first and second rim portions; a display sheet receivable through the opening in the body for mounting within the body intermediate of the mirror and the first rim portion; retaining means receivable through the opening in the body intermediate the mirror and the display sheet for releasably positioning the last mentioned elements within the body; and support means for supporting the body, including magnetic means adapted to releasably engage the first and second faces of the rim portions.

DESCRIPTION OF ONE FORM OF THE INVENTION

Figure 1:
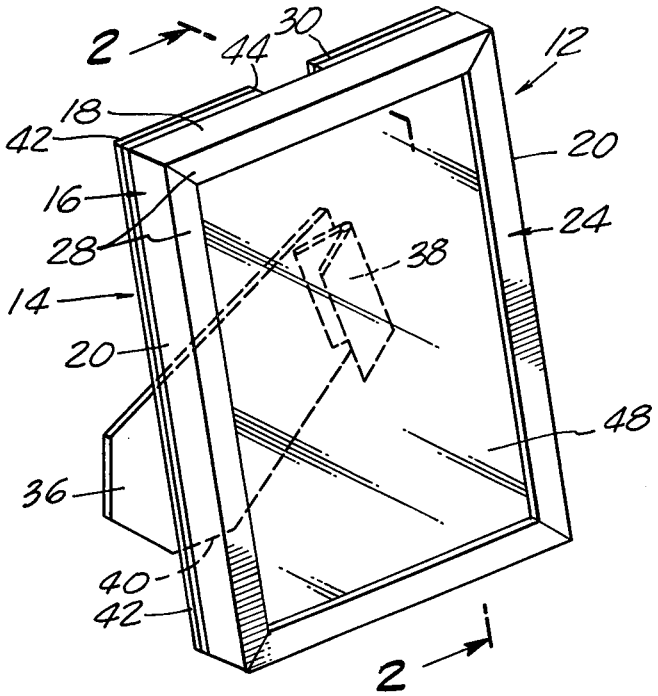
FIG. 1 is a generally perspective view of the combination mirror and display device of the invention.
Figure 2:
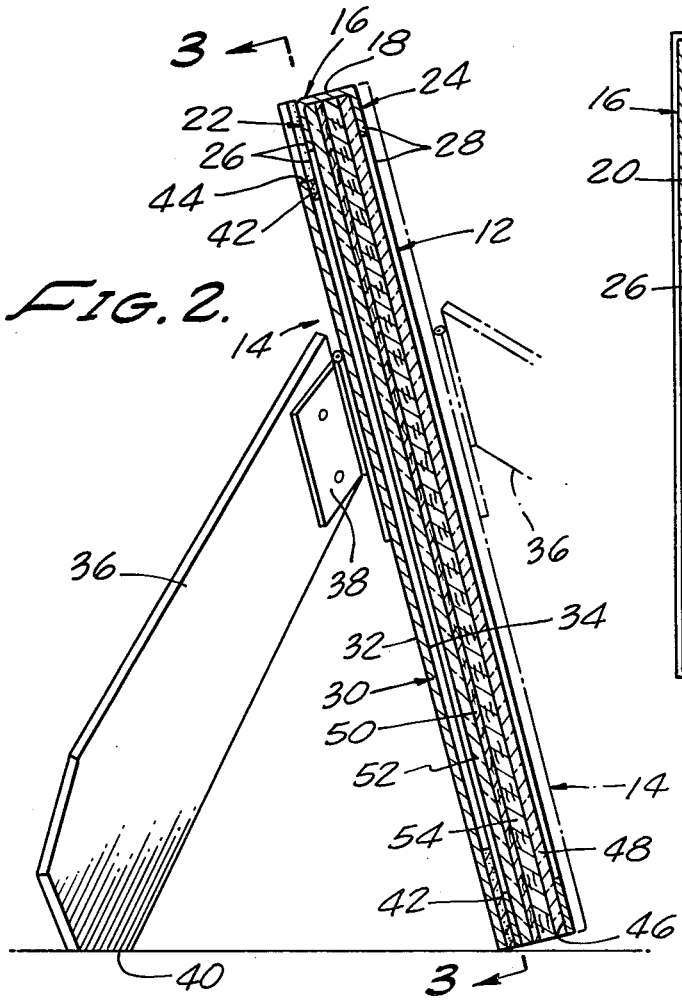
FIG. 2 is a cross sectional view taken along line 2—2 of FIG. 1.

Referring to the drawings, and particularly to FIGS. 1 and 2, the combination mirror and display device of the present invention comprises a display unit 12 and a support means 14 for holding the display unit in a substantially upright position. Display unit 12 comprises a body portion 16 having interconnected top and side walls 18 and 20 respectively. Connected to the peripheral edges of body 16 and presenting first and second faces 22 and 24 respectively (FIG. 2) are first and second oppositely facing peripheral rim portions 26 and 28 respectively. Rim portions 26 and 28 are constructed of a magnetic material, such as a thin gauge iron or steel.

As best seen in FIG. 2, in this form of the invention support means 14 comprises a rigid backing member 30 having substantially planar front and rear faces 32 and 34 respectively. Backing member 30 may be constructed of any suitably rigid material such as wood, plastic, masonite, chip board, cardboard or like material.

Hingably connected to the rear face 32 of backing member 30 is a supporting leg 36 adapted, in its operative position, to hold the backing member in the substantially upright position illustrated in FIG. 2. Leg 36 is also constructed of a rigid material such as masonite, plastic, chip board, or the like, and is connected to the rear surface of support of backing member 30 by a hinge means 38. Leg 36 may be moved from a folded position wherein it lies against the rear face of backing member 30 into an operative position wherein it extends at an acute angle relative to the backing member. At the base of the leg 36 there is provided a surface engaging portion 40 adapted to rest against any flat surface such as the top of a desk or table.

Figure 3:
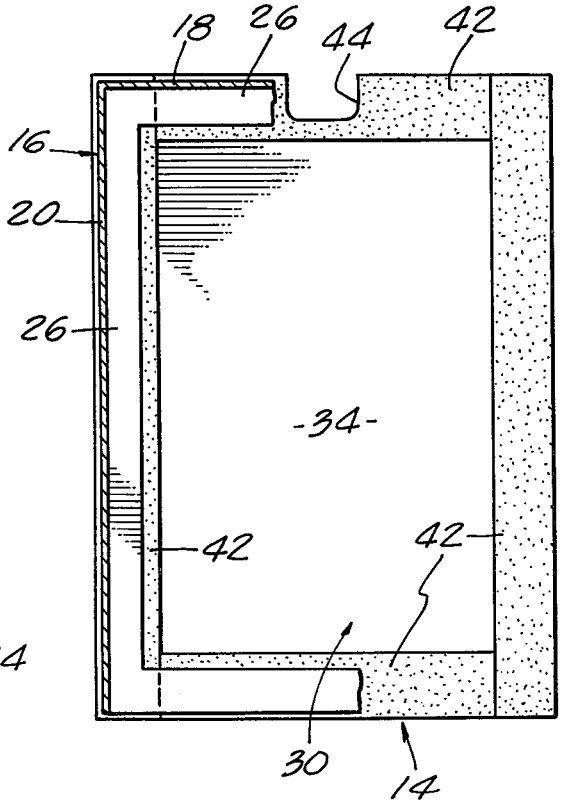
FIG. 3 is a view taken along line 3—3 of FIG. 2.

Turning to FIG. 3, support means 14 also includes magnetic means adapted to releasably engage the first and second faces 24 and 26 of rim portions 26 and 28. In the embodiment of the invention shown in the drawings, the magnetic means are provided in the form of several strips 42 of a permanent magnet material suitably affixed, as by adhesive bonding, along the marginal portions of front face 32 of support member 30. While any type of permanent magnet material may be used to form strips 42, magnetic tape in the form of strips of flexible rubber or plastic compositions containing a permanently magnified finely divided filler such as a strongly magnetic ferrite has proven most satisfactory. As illustrated in FIG. 3 a notched out portion 44, the purpose of which will presently be described, is provided at the top of backing member 30.

Receivable through the bottom open end 46 of body 16 is a planar sheet mirror 48. Mirror 48 is adapted to be carried within body 16 intermediate first and second rim portion 26 and 28, and, in a manner presently to be described, is normally held firmly against the rear surfaces of rim portions 26 and 28 by a retaining means. Also receivable through the bottom open end of body 16 is a display sheet 50 which may be in the form of a photograph, picture, line drawing, calendar sheet or the like. Display sheet 50 is adapted to be carried within body 16 intermediate mirror 48 and first rim portion 26. Although not absolutely necessary, it is preferable to provide a sheet of rigid transparent material 52 such as glass or plastic such as a polyacrylic resin to cover and protect the display sheet. As can be seen in FIG. 2, transparent sheet 52 is receivable through the open bottom end of body 16 and is adapted to be held within the body intermediate display sheet 50 and the rear surface of rim portion 26.

For releasably positioning mirror 48, display sheet 50 and transparent sheet 52 within body portion 16, there is provided retaining means shown here in the form of a substantially planar member 54 which is located intermediate mirror 48 and display sheet 50. Member 54 is of a size approximately equal to the size of mirror 48 and is constructed of a resillently compressable material such as cardboard or the like. Member 54 is of such a thickness that when in position within the body 16 it is under compression and tends to exert forces urging mirror 48 and transparent sheet 52 firmly into engagement with the rear surfaces of rims 28 and 26 respectively.

With the device in the "mirror out" configuration shown in the drawings, it can be conveniently used in an office or in a home as a free-standing looking glass. By grasping the support or backing member 14 in one hand and inserting the thumb of the other hand into the notched out portion 44, the display unit can readily be separated from the backing member. The display unit can thus be turned over and repositioned against the backing member in the manner illustrated in the phantom lines of FIG. 2 with rim surfaces 24 in engagement with the magnetic means. In this configuration the display unit is held firmly centered against the backing member with the magnitic means hidden from view so that the device appears to be nothing more than a picture frame of conventional design.

Having now described the invention in detail in accordance with the requirements of the patent statues, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A combination mirror and display device comprising:

(a) a body portion having an opening therein and defining oppositely disposed peripheral edges;

(b) first and second oppositely facing peripheral rim portions connected to said peripheral edges of said body and presenting first and second faces constructed of a magnetic material;

(c) a mirror receivable through said opening in said body for mounting within said body intermediate said first and second rim portions;

(d) a display sheet receivable through said opening in said body for mounting within said body intermediate said mirror and said first rim portion;

(e) retaining means receivable through said opening in said body intermediate said mirror and said display sheet for releasably positioning said last mentioned elements within said body; and (f) support means for supporting said body portion, including a rigid backing member having magnetic means affixed thereto said magnetic means comprising strips of magnetic material affixed to said backing member and being adapted to releasably engage said first and second faces of said rim portions.

2. A device as defined in claim 1 in which said backing member is provided with a notched out portion along one margin thereof for inserting a finger to facilitate separation of said body portion from said backing member.

3. A combination mirror and display device comprising:

(a) a generally rectangular display unit having:

(1) a body comprising interconnected top and side walls;

(2) first and second peripheral rim portions provided on opposite sides of said body, said rim portions presenting first and second opposing, substantially planar faces constructed of a magnetic material;

(3) a substantially planar mirror removably carried within said body intermediate said first and second rims;

(4) a display sheet removably carried within said body intermediate said mirror and said first rim portion; and (5) retaining means removably carried within said body intermediate said mirror and said display sheet for holding said mirror and display sheet in a fixed position within said body;

(b) a rigid, planar backing member; and (c) magnetic means carried by said backing member for releasably engaging at least portions of said first and second faces of said rim portions.

4. A device as defined in claim 3 in which said retaining means comprises a substantially planar member of a size approximately the size of said mirror, said member being constructed of a resiliently compressable material of a thickness whereby when said member is in position within said body it is under compression and exerts forces tending to urge said mirror and display sheets against said rim portions of said body.

5. A device as defined in claim 3 including a transparent member disposed within said body intermediate said display sheet and said first rim portion.

6. A combination mirror and display device comprising:

(a) a generally rectangular display unit having:

(1) a body comprising interconnected top and side walls;

(2) first and second peripheral rim portions provided on opposite sides of said body, said rim portions presenting first and second opposing, substantially planar faces constructed of a magnetic material;

(3) a substantially planar mirror removably carried within said body intermediate said first and second rims;

(4) a display sheet removably carried within said body intermediate said mirror and said first rim portion; and (5) retaining means removably carried within said body intermediate said mirror and said display sheet for holding said mirror and display sheet in a fixed position within said body said retaining means comprising a substantially planar member of a size approximately the size of said mirror, said member being constructed of a resiliently compressable material of a thickness whereby when said member is in position within said body it is under compression and exerts forces tending to urge said mirror and display sheets against said rim portions of said body;

(b) a rigid, planar backing member provided with a notched out portion along one margin thereof for inserting a finger to facilitate separation of said body portion from said backing member; and (c) magnetic means carried by said backing member for releasably engaging at least portions of said first and second faces of said rim portions.

* * * * *